US006837786B2

(12) United States Patent
Linde et al.

(10) Patent No.: US 6,837,786 B2
(45) Date of Patent: Jan. 4, 2005

(54) PROGRAMMABLE REMOTE-CONTROL MOTION VENT OUTLET

(76) Inventors: Kenneth J. Linde, 4814 Hickory La., Mchenry, IL (US) 60050; Syed R. Naqui, 204 Longridge Dr., Bloomingdale, IL (US) 60108

( * ) Notice: Subject to any disclaimer, the term of this patent is extended or adjusted under 35 U.S.C. 154(b) by 51 days.

(21) Appl. No.: 10/338,967

(22) Filed: Jan. 10, 2003

(65) Prior Publication Data

US 2004/0137838 A1 Jul. 15, 2004

(51) Int. Cl.[7] ..... F24F 7/00
(52) U.S. Cl. ..... 454/256; 454/333
(58) Field of Search ..... 454/325, 333, 454/335, 256

(56) References Cited

U.S. PATENT DOCUMENTS 3,597,531 A * 8/1971 De Marinis et al. ..... 455/163.1
3,688,268 A * 8/1972 Bedjai et al. ..... 340/5.28
4,729,293 A * 3/1988 Tsunoda et al. ..... 454/313
4,911,065 A * 3/1990 Van Becelaere ..... 454/369
4,969,508 A * 11/1990 Tate et al. ..... 165/209
5,272,477 A * 12/1993 Tashima et al. ..... 340/870.16
5,345,966 A * 9/1994 Dudley ..... 137/601.08
5,461,382 A * 10/1995 Deguchi et al. ..... 341/176
5,533,668 A * 7/1996 Erikson ..... 236/49.3
5,598,162 A * 1/1997 Terashima et al. ..... 341/176
5,670,074 A * 9/1997 Kass et al. ..... 219/481
5,833,134 A * 11/1998 Ho et al. ..... 236/49.3
5,952,996 A * 9/1999 Kim et al. ..... 345/158
6,220,518 B1 * 4/2001 Kline et al. ..... 236/49.3
6,364,211 B1 * 4/2002 Saleh ..... 236/49.3

* cited by examiner

*Primary Examiner*—Derek S. Boles
(74) *Attorney, Agent, or Firm*—Raymond Y. Chan; David and Raymond Patent Group

(57) ABSTRACT

A programmable remote-control motion vent outlet includes an air vent arrangement and a control device. The air vent arrangement includes a ventilating guide adapted for mounting at a ventilating air outlet, wherein the ventilating guide has a ventilating slot for guiding an airflow passing from the ventilating air outlet to outside, a plurality of vent blades rotatably mounted to the ventilating guide for selectively allowing the airflow passing through the ventilating slot. The control device is adapted for remotely switching the vent blades between an air passage position and an air blockage position. In which, at the air passage position, the vent blades are rotated to open the ventilating slot respectively for allowing the airflow passing therethrough, and at the air blockage position, the vent blades are rotated to close the ventilating slot respectively for blocking the airflow passing through.

20 Claims, 6 Drawing Sheets

PROGRAMMABLE REMOTE-CONTROL MOTION VENT OUTLET

BACKGROUND OF THE PRESENT INVENTION

1. Field of Invention

The present invention relates to an air conditioning system, and more particularly to a programmable remote-control motion vent outlet, wherein the user is able to selectively open the vent outlet for allowing the air flow into the corresponding room and close the vent outlet for blocking the air flow therethrough by means of a remote control system, so as to ensure efficient operation of air condition system.

2. Description of Related Arts

Nowadays, ventilation system plays a main role for all modern buildings such as office and home to be well ventilated in order to provide a comfortable indoor climate condition for the residents. For example, the resident is able to turn on the air conditioning during the summer time and the heater during the wintertime, so as to set an acceptable indoor climate condition. Generally speaking, the ventilation system generates a flow of cool or warm air to each room of the building through a ventilation outlet mounted on a ceiling, wall, or roof of each room of the building.

However, such ventilating configuration has a major drawback that when the air conditioning is switched on, the ventilation system must generate sufficient cool or warm air flowing towards all the rooms even though some of the rooms are not occupied. In other words, once the user turns on the air conditioning, the air conditioning must generate enough air flowing to each single room, which is a waste of energy.

The most common and easiest way to stop the air flowing to the unoccupied room is to close the ventilation outlet thereof. However, most of the ventilation outlets are mounted at the ceiling of the room, it is quite inconvenience for the user to climb up to the ceiling of the room in order to close the ventilation outlet.

Therefore, an airflow control system is usually incorporated with the ventilation system to control the air flowing to a desired room. The airflow control system generally comprises a computerized center linked to each of the ventilation outlets in such a manner that the user is able to control each ventilation outlet in an open and close manner. However, the installation cost of such computerized center is relatively expensive that is not ideally fit for either the home usage or the big building having plenty of rooms.

Alternatively, the airflow control system can direct the airflow by means of fluid dynamic. In other words, when the temperature of the particular room does not reach the preset climate thereof, the airflow control system will direct a larger portion of the airflow to the room. However, such airflow control system cannot stop the airflow directing to the room that the room temperature thereof is already reach the preset climate or the room is unoccupied. Therefore, it is still a waste of energy for the air conditioning to generate the airflow towards the unoccupied room.

SUMMARY OF THE PRESENT INVENTION

A main object of the present invention is to provide a programmable remote-control motion vent outlet, wherein the user is able to selectively open the motion vent outlet for allowing the ventilating air flowing into the corresponding room and close the motion vent outlet for blocking the ventilating air flowing therethrough by means of a remote control system, so as to ensure efficient operation of air condition system.

Another object of the present invention is to provide a programmable remote-control motion vent outlet, which can guide and evenly distribute a flow of ventilating air to a desired room while being cost effective and energy efficient.

Another object of the present invention is to provide a programmable remote-control motion vent outlet, wherein the installation operation of the simple and fast that one individual is able to self-install the motion vent outlet to a ceiling of the room as if the installation of the conventional vent outlet.

Another object of the present invention is to provide a programmable remote-control motion vent outlet, wherein the switch of the motion vent outlet can be a manual switch or a remote control to operate the motion vent outlet in an open and close manner. In addition, the switch of the motion vent outlet is capable of incorporating with an existing light switch so that no additional switch is required to employ in the room.

Another object of the present invention is to provide a programmable remote-control motion vent outlet, wherein the original configuration of the air conditioning system does not require to be altered in order to incorporate with the present invention, so as to reduce the installation cost of the air conditioning system incorporating with the motion vent outlet.

Another object of the present invention is to provide a programmable remote-control motion vent outlet, wherein no expensive or complicated structure is required to employ in the present invention in order to achieve the above mentioned objects. Therefore, the present invention successfully provides an economic and efficient solution for not only permitting the air flowing into the room but also saving the energy of the air conditioning system to generate sufficient airflow to the occupied room only.

Accordingly, in order to accomplish the above objects, the present invention provides a programmable remote-control motion vent outlet, comprising:

a ventilating guide adapted for mounting at a ventilating air outlet, wherein the ventilating guide has a ventilating slot for an airflow passing from the ventilating air outlet to outside;

an airflow baffle comprising a plurality of vent blades rotatably mounted to the ventilating guide for selectively allowing the airflow passing through the ventilating slot; and a control device, which is electrically connected to a power source, comprising means for switching the vent blades of the airflow baffle between an air passage position and an air blockage position, wherein at the air passage position, the vent blades are rotated to open the ventilating slot respectively for allowing the airflow passing therethrough, and at the air blockage position, the vent blades are rotated to close the ventilating slot respectively for blocking the airflow passing through.

The present invention also provides a method of controlling an airflow passing through a vent outlet, comprising the steps of (a) communicatively connecting the air vent arrangement with the control device,; and (b) remote-controlling the vent blades between an air passage position and an air blockage position, wherein at the air passage position, the vent blades are rotated to open the ventilating slot for allowing the airflow passing therethrough, and at the air blockage position, the vent blades are rotated to close the ventilating slot for blocking the airflow passing through.

These and other objectives, features, and advantages of the present invention will become apparent from the following detailed description, the accompanying drawings, and the appended claims.

DETAILED DESCRIPTION OF THE PREFERRED EMBODIMENT

Figure 1:
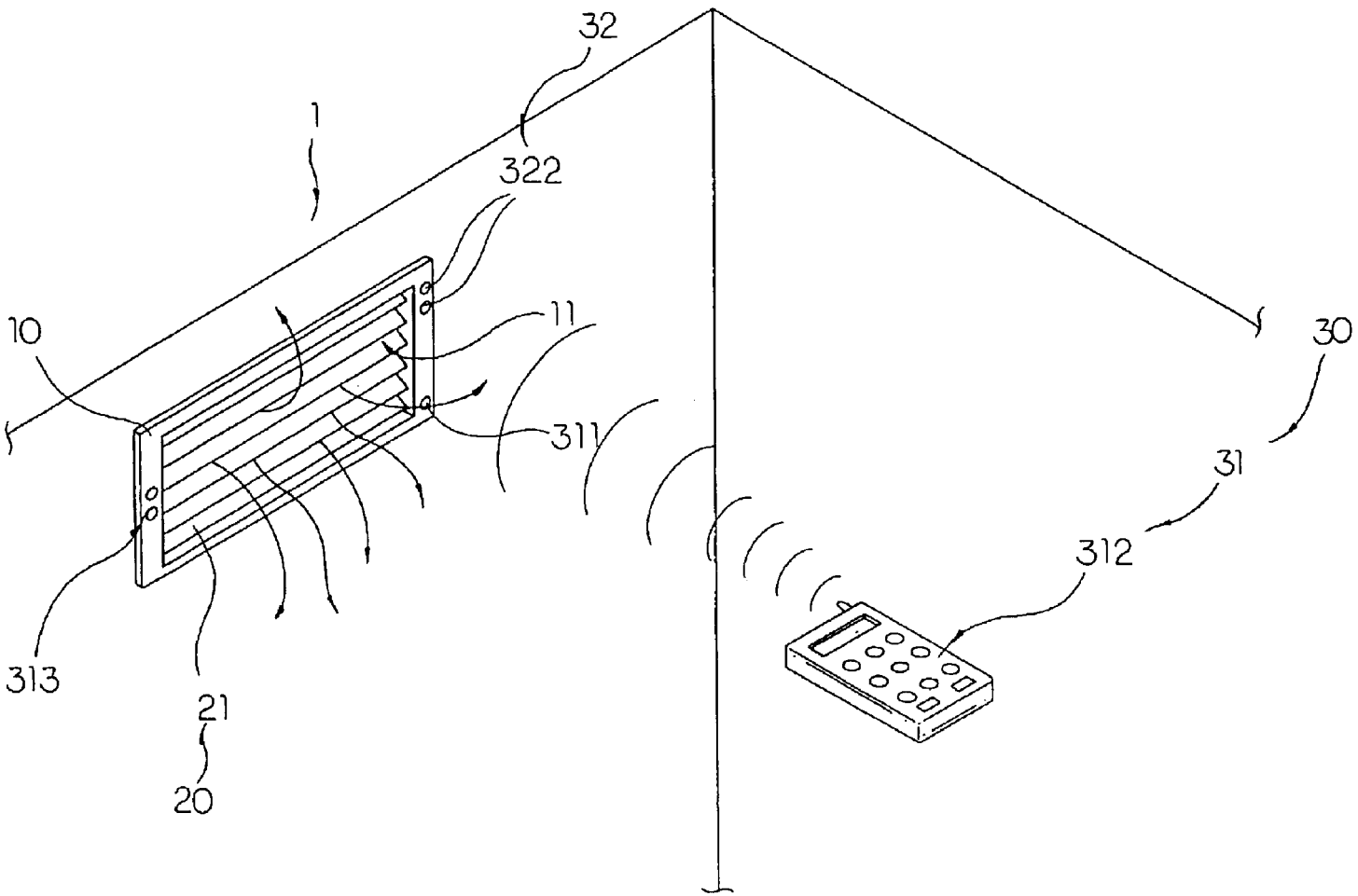
FIG. 1 is a perspective view of a programmable remote-control motion vent outlet according to a preferred embodiment of the present invention.
Figure 2:
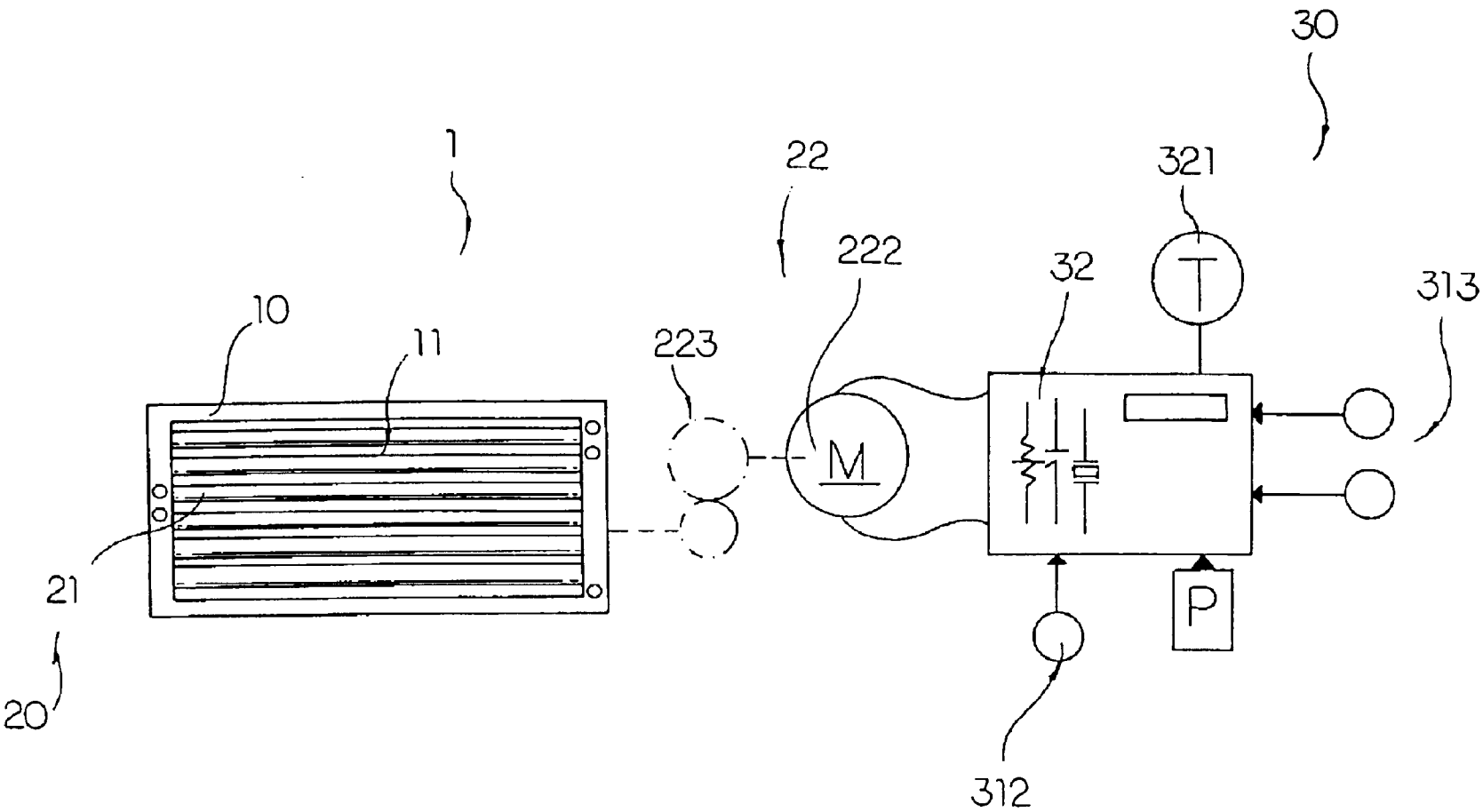
FIG. 2 is a block diagram of the programmable remote-control motion vent outlet according to the above preferred embodiment of the present invention.

Referring to FIGS. 1 and 2 of the drawings, a programmable remote-control motion vent outlet according to a first preferred embodiment of the present invention is illustrated, which comprises an air vent arrangement 1 and a control device 30.

The air vent arrangement 1 comprises a ventilating guide 10 adapted for mounting at a ventilating air outlet, wherein the ventilating guide 10 has a ventilating slot 11 for an airflow A passing from the ventilating air outlet to outside, and an airflow baffle 20 comprising a plurality of vent blades 21 rotatably mounted to the ventilating guide 10 for selectively allowing the airflow A passing through the ventilating slot 11.

The control device 30, which is electrically connected to a power source P, comprising means 31 for switching the vent blades 21 of the airflow baffle 20 between an air passage position and an air blockage position, wherein at the air passage position, the vent blades 21 are rotated to open the ventilating slot 11 respectively for allowing the airflow A passing therethrough, and at the air blockage position, the vent blades 21 are rotated to close the ventilating slot 11 respectively for blocking the airflow A passing through.

According to the first embodiment, the air vent arrangement 1, which can be any convention ventilation outlet, is mounted on a roof, ceiling or even a wall for exhausting or supplying the airflow A to outside through the ventilating slot 11.

Each of the vent blades 21 has two axis ends 211 rotatably mounted on the ventilating guide 10 at the respective ventilating slot 11 in such a manner that the vent blades 12 are adapted to be selectively rotated to enclose the ventilating slot 11 for blocking the airflow A passing therethrough or to open the ventilating slot 11 for permitting the airflow A pass through the ventilating slot 11 respectively.

Figure 3:
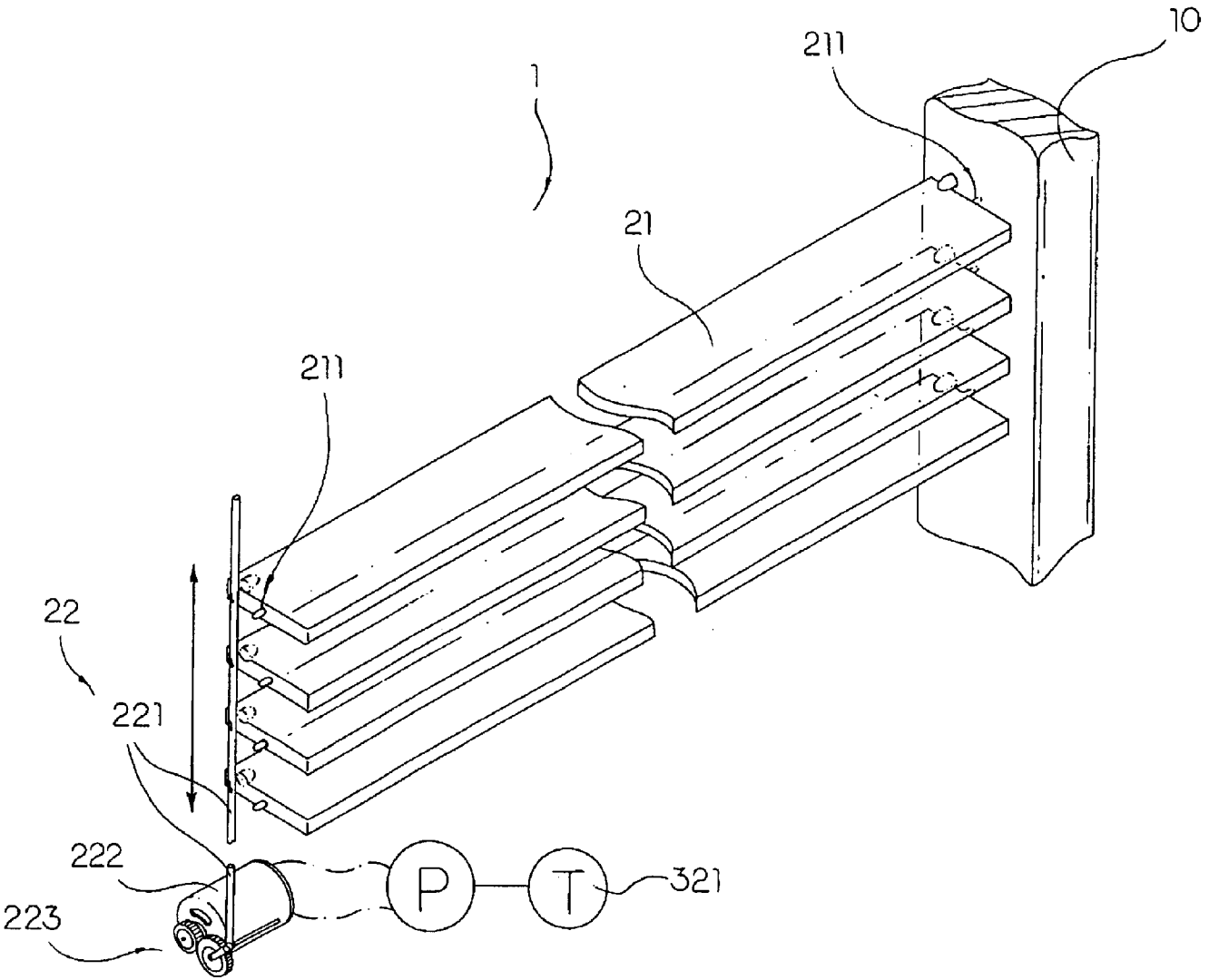
FIG. 3 is a perspective view of an airflow baffle of the programmable remote-control motion vent outlet according to the above preferred embodiment of the present invention.

The air baffle 20 further comprises means 22 for rotatably driving the vent blades 21 between the air passage position and the air blockage position. The driving means 22, according to the preferred embodiment, is a motorizing unit which comprises a driving arm 221 pivotally connected to one of the axis ends 211 of each of the vent blades 21 and a motor 222 electrically connected to the power source P and arranged to drive the driving arm 221 through a gear unit 223 to rotate the vent blades 21 between the air blockage position and the air passage position, as shown in FIG. 3.

Figure 4A:
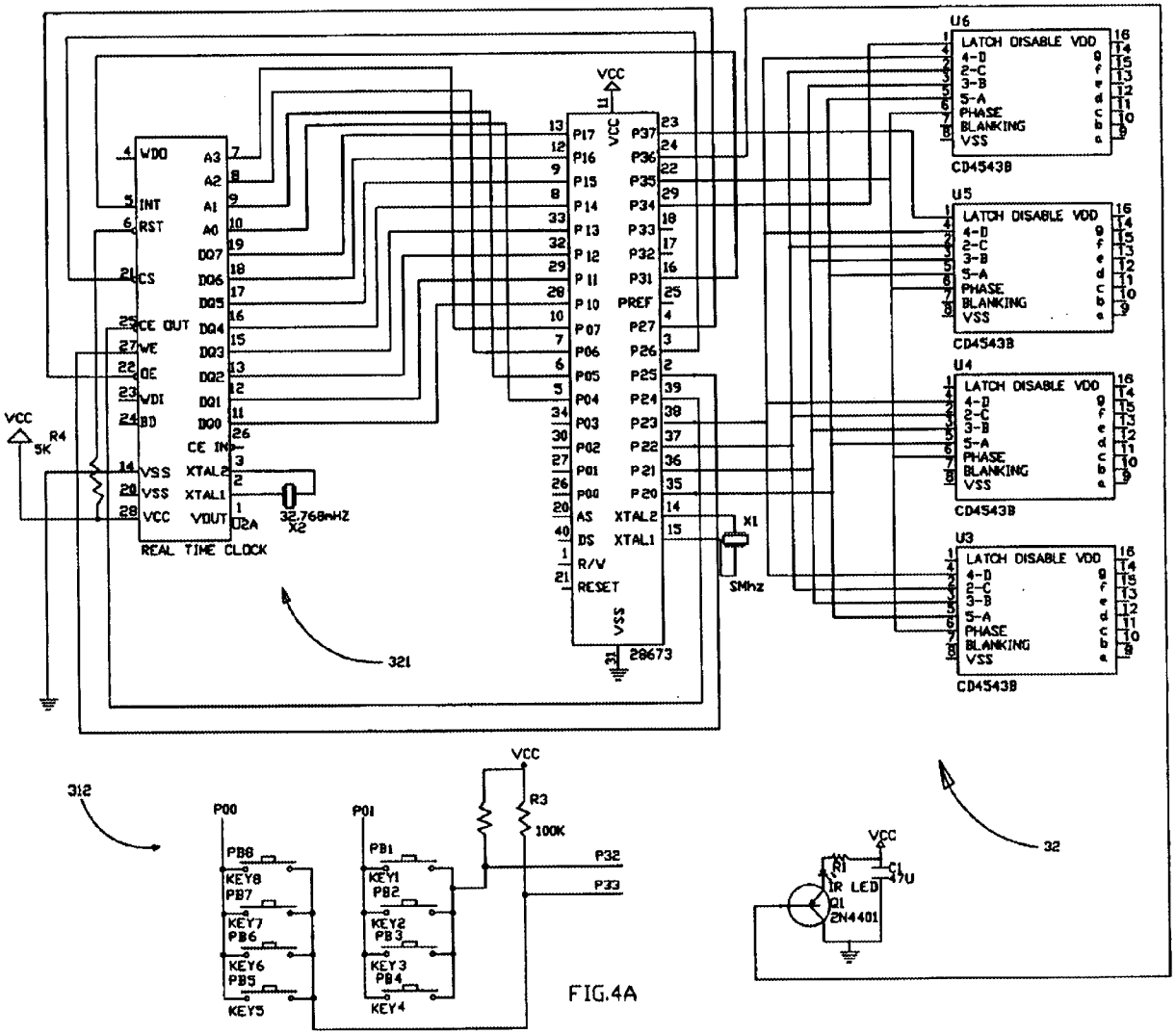
FIGS. 4A and 4B are circuit diagrams of the programmable remote-control motion vent outlet according to the above preferred embodiment of the present invention.
Figure 4B:
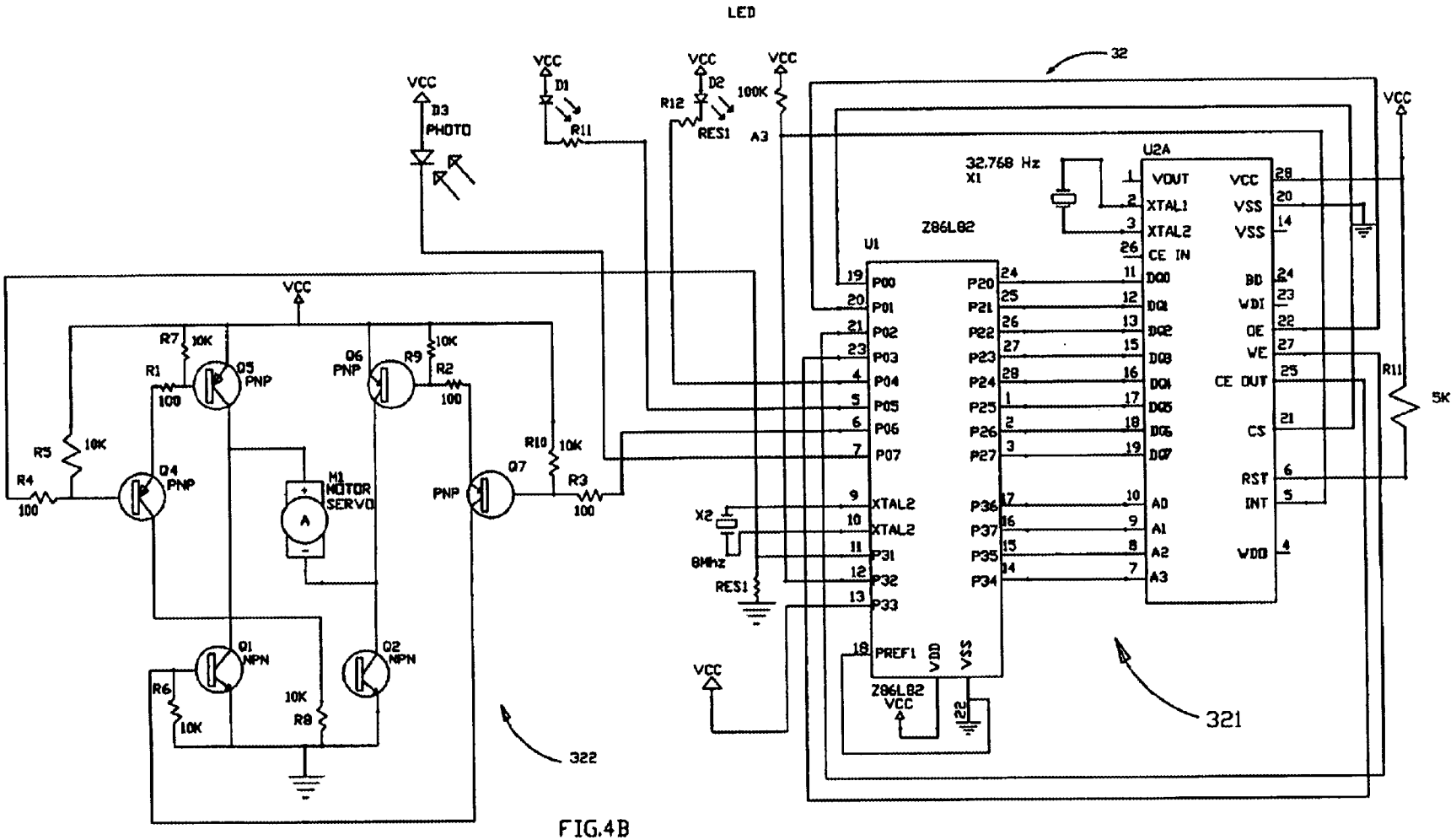

The control device 30 further comprises an electric circuit 32 electrically connected with the switching means 31 to control the air baffle 20, as shown in FIGS. 4A and 4B. Accordingly, the electric circuit 32 comprises a timer circuit 321 arranged for activating the driving means 22 to actuate the vent blades 21 to rotate at a predetermined time setting. In other words, the user is able to set the time interval to selectively open or close the ventilating slot 11 for allowing or blocking the airflow A passing therethrough respectively.

The electric circuit 32 further comprises means 322 for indicating the vent blades 21 between the air passage position and the air blockage position. As shown in FIG. 1, the indicating means 322 comprises at least a LED light provided on the ventilating guide 10. Preferably, there are two LED lights provided on the ventilating guide 10 wherein one of the LED lights indicates the vent blades 21 at the air passage position while another LED light indicates the vent blades 21 at the air blockage position.

The switching means 31, according to the preferred embodiment, is a wireless remote control comprising a signal receiver 311 electrically connected to the motorizing unit 32 and a hand held controller 312 wirelessly communicating with the signal receiver 311 to control the rotational movements of the vent blades 21. Accordingly, the hand held controller 312 is capable of remote-controlling more than one air baffle 20 such that the user is able to use the hand held controller 312 to control all the air baffles 20 installed into the rooms of the building respectively. Therefore, the operation of the present invention is simply as remote controlling a television.

The switching means 31 is communicating with the air vent arrangement 1 through radio frequency signals to remotely control the rotational movements of the vent blades 21. The hand held controller 312 is a radio frequency transmitting device adapted to send the radio frequency to the signal receiver 311 such that the switching means 31 functions as a wireless communication link between the air vent arrangement 1 and the control device 30.

Accordingly, due to the long range the radio frequency, the control device 30 is capable of controlling more than one air vent arrangement 1 wherein each of the air vent arrangement 1 is preset at a radio frequency channel. For example, the air vent arrangement 1 at room A with a preset radio frequency channel 1 and another air vent arrangement 1 at room B with a preset radio frequency channel 1 can be selectively controlled by the hand held controller 312 while the user, such as a hotel manager, is located in the lobby.

Furthermore, the user is able to tune the hand held controller 312 at a predetermined radio frequency to communicate with the signal receiver 311 to remotely control the air vent arrangement 1, so that the hand held controller 312 is capable of controlling at least two air vent arrangements 1 by using different radio frequencies. Alternatively, the hand held controller 312 is capable of automatically matching the radio frequency to communicate with the signal receiver 311 to remotely control the air vent arrangement 1.

In addition, a display screen is provided on the hand held controller 312 wherein the user is allowed to program the open and close times of the ventilation guide 10 as a time setting to the timer circuit 321 while the time setting is displayed on the display screen of the hand held controller 312. It is worth to mention that the user is able to individually program the present invention for each of the rooms such that the ventilating guide 10 at each room will be individually opened and closed at a preset time.

The control device 30 further comprises a manual switch 313 provided on the ventilating guide 10 to control the rotational movements of the vent blades 21 manually, so as to prevent an unattended operation of the present invention. It is worth to mention that when the air baffle 20 is manually activated by the manual switch 313, the manual operation of the air baffle 20 will override the time setting programmed through the hand held controller 312.

Therefore, the user is able to operate the present invention by mounting the ventilating guide 10 at the ventilating air outlet such that the airflow A is capable passing through the ventilating slot 11, and remote-controlling the air baffle 20 between the air passage position and the air blockage position. In other words, the installation of the present invention is easy and simply that by just replacing the original ventilating air outlet since the present invention is useable in both new and existing dwellings.

Accordingly, the user is able to remote-control the open and close of the ventilating guide 10 for each room of the building so as to save the energy of the air conditioning system for providing extra airflow A to the unoccupied rooms. For example, a householder is able to close the ventilating guide 10 at the guest room while the ventilating guide 10 at the living room is left open, so that the air conditioning system can only generate sufficient airflow A towards the living room, which can save the energy of providing the airflow A towards the guest room.

Likewise, an individual is able to program the time of the switching means 31 so that the ventilating guide 10 at the particular room will be automatically switched on and off according to the time setting. Also, a hotel manager is able to switch on the ventilating guide 10 when the room is occupied and switch off the ventilating guide 10 after the guest of that room is checked out.

Figure 5:
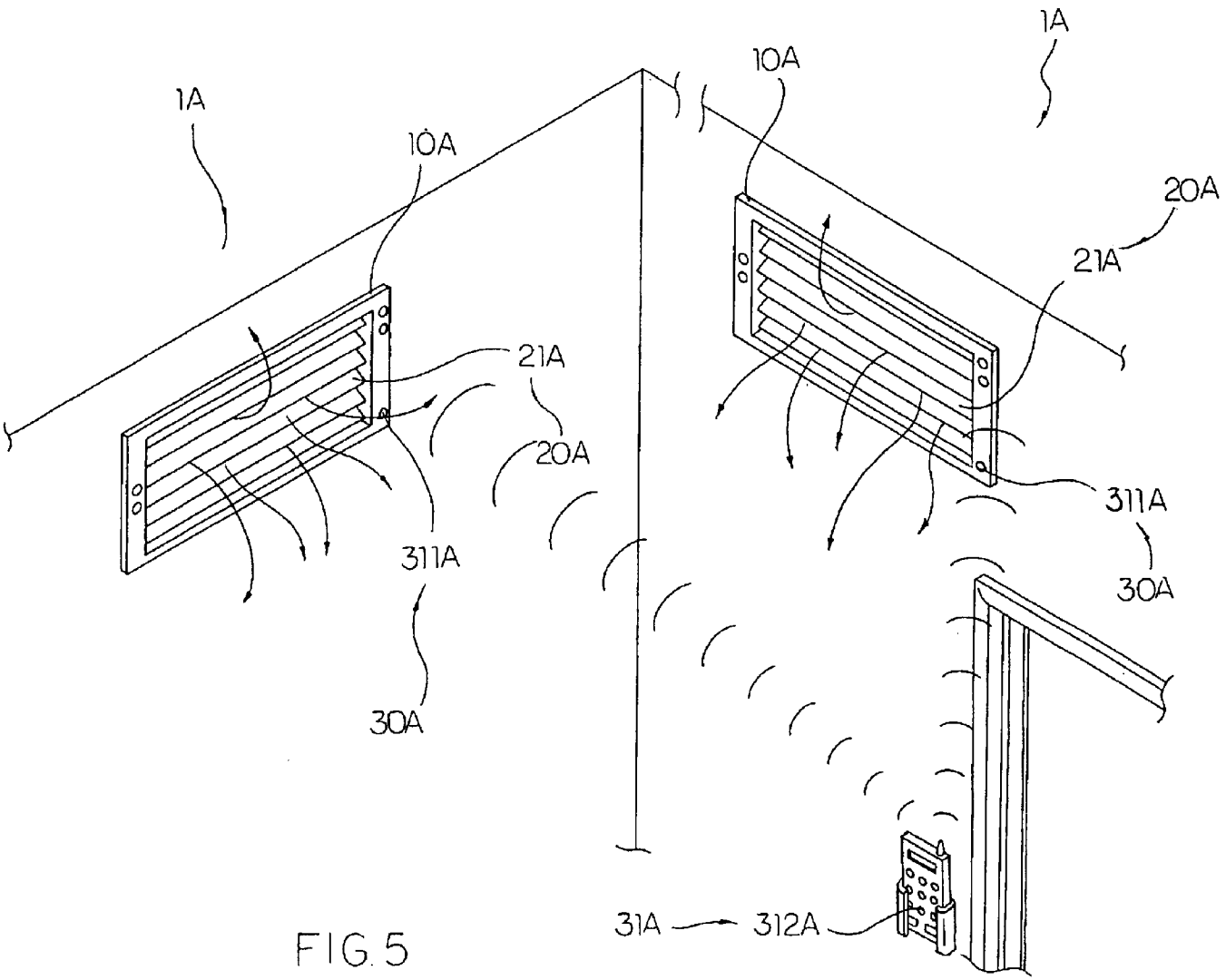
FIG. 5 illustrates an alternative mode of the switching means of the programmable remote-control motion vent outlet according to the above preferred embodiment of the present invention.

FIG. 5 illustrates an alternative mode of the switching means 31A which comprises a control switch 311A electrically extended from the air blade 20A and adapted for mounting on a wall in such a manner that the user is able to manually switch on the air baffle 20A to control the rotational movements of the vent blades 21 A.

The switching means 31A is communicating with the air vent arrangement 1A through infrared signals to remotely control the rotational movements of the vent blades 21A. The hand held controller 312A is an infrared transmitting device adapted to send the infrared signals to the signal receiver 311A such that the switching means 31A functions as a wireless communication link between the air vent arrangement 1A and the control device 30A.

The user is able to tune the hand held controller 312A at a predetermined infrared signal to communicate with the signal receiver 311A to remotely control the air vent arrangement 1A. Alternatively, the hand held controller 312A is capable of automatically matching the infrared signal to communicate with the signal receiver 311A to remotely control the air vent arrangement 1A.

In comparison with the radio frequency signals, the communicating range of the infrared signals is shorter than that of the radio frequency signals. However, the infrared signal is more accurate than the radio frequency signal, so that the control device 30A is capable of precisely control the particularly air vent arrangement 1A through the infrared signals. Especially when there are at least two air vent arrangements 1A installed in one room, the switching means 31 A is capable of accurately controlling each of the air vent arrangements 1A through different channels by means of the infrared signals.

It is worth to mention that the control switch 311A can be incorporated with a light switch such that when the user switches on the light in the room, the ventilating guide 10A is opened at the same time for permitting the airflow A entering into the room. In other words, when the user leaves the room and turns off the light, the ventilating guide 10A is automatically closed to block the airflow A entering into the room, so as to save the energy of the air conditioning system when the room is unoccupied.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A programmable remote-control motion vent outlet, comprising:

an air vent outlet arrangement, comprising:

a ventilating guide adapted for mounting at a ventilating air outlet, wherein said ventilating guide has a ventilating slot for an airflow passing from said ventilating air outlet to outside; and an airflow baffle comprising a plurality of vent blades rotatably mounted to said ventilating guide for selectively allowing said airflow passing through said ventilating slot; and a control device electrically connected to a power source for remotely switching said vent blades of said airflow baffle between an air passage position and an air blockage position, wherein said control device comprises a switching device comprising a signal receiver electrically connected to said air baffle and a hand held controller wirelessly communicating with said signal receiver to control rotational movements of said vent blades, wherein at said air passage position, said vent blades are rotated to open said ventilating slot respectively for allowing said airflow passing therethrough, and at said air blockage position, said vent blades are rotated to close said ventilating slot respectively for blocking said airflow passing through.

2. A programmable remote-control motion vent outlet, as recited in claim 1, wherein said hand held controller is a radio frequency transmitting device sending a radio frequency to said signal receiver such that said switching means functions as a wireless communication link between said air vent arrangement and said control device.

3. A programmable remote-control motion vent outlet, as recited in claim 1, wherein said hand held controller is an infrared transmitting device sending an infrared signal to said signal receiver such that said switching means functions as a wireless communication link between said air vent arrangement and said control device.

4. A programmable remote-control motion vent outlet, as recited in claim 1, wherein said control device further comprises a manual switch controlling said rotational movements of said vent blades manually, wherein said manual switch overrides said switching means in remote control manner.

5. A programmable remote-control motion vent outlet, as recited in claim 2, wherein said control device further comprises a manual switch controlling said rotational movements of said vent blades manually, wherein said manual switch overrides said switching means in remote control manner.

6. A programmable remote-control motion vent outlet, as recited in claim 3, wherein said control device further comprises a manual switch controlling said rotational movements of said vent blades manually, wherein said manual switch overrides said switching means in remote control manner.

7. A programmable remote-control motion vent outlet, as recited in claim 1, wherein said control device further comprises an electric circuit electrically connected with said switching device to control said air baffle, wherein said electric circuit comprises a timer circuit arranged for actuating said vent blades to rotate at a predetermined time setting.

8. A programmable remote-control motion vent outlet, as recited in claim 5, wherein said control device further comprises an electric circuit electrically connected with said switching device to control said air baffle, wherein said electric circuit comprises a timer circuit arranged for actuating said vent blades to rotate at a predetermined time setting.

9. A programmable remote-control motion vent outlet, as recited in claim 6, wherein said control device further comprises an electric circuit electrically connected with said switching device to control said air baffle, wherein said electric circuit comprises a timer circuit arranged for actuating said vent blades to rotate at a predetermined time setting.

10. A method of remote-controlling a motion vent outlet which comprises at least an air vent arrangement and a control device, wherein said air vent arrangement comprises a ventilating guide having a ventilating slot and a plurality of vent blades rotatably and spacedly mounted said ventilating guide for guiding an airflow passing through said ventilating slot to outside and said control device comprises a signal receiver electrically connected to said air baffle and a hand held controller;

wherein the method comprises the steps of:

(a) communicatively connecting said air baffle of said air vent arrangement with said hand held controller of said control device;

(b) wireless communicating said hand held controller with said signal receiver by wireless signals; and (c) remote-controlling rotational movements of said vent blades between an air passage position and an air blockage position by said control device, wherein at said air passage position, said vent blades are rotated to open said ventilating slot for allowing said airflow passing therethrough, and at said air blockage position, said vent blades are rotated to close said ventilating slot for blocking said airflow passing through.

11. The method, as recited in claim 10, wherein, in the step (b), said hand held controller communicates with said signal receiver through radio frequency signals to remotely control said rotational movements of said vent blades.

12. The method, as recited in claim 11, wherein said hand held controller is a radio frequency transmitting device adapted to send said radio frequency to said signal receiver such that said switching means functions as a wireless communication link between said air vent arrangement and said control device.

13. The method, as recited in claim 11, wherein the step (a) further comprises a step of tuning said hand held controller at a predetermined radio frequency to communicate with said signal receiver to remotely control said air vent arrangement.

14. The method, as recited in claim 11, wherein the step (a) further comprises a step of automatically matching said radio frequency of said hand held controller to communicate with said signal receiver to remotely control said air vent arrangement.

15. The method, as recited in claim 10, wherein, in the step (b), said hand held controller communicates with said signal receiver through infrared signals to remotely control said rotational movements of said vent blades.

16. The method, as recited in claim 15, wherein said hand held controller is an infrared transmitting device adapted to send said infrared signals to said signal receiver such that said switching means functions as a wireless communication link between said air vent arrangement and said control device.

17. The method, as recited in claim 15, wherein the step (a) further comprises a step of tuning said hand held controller at a predetermined infrared signal to communicate with said signal receiver to remotely control said air vent arrangement.

18. The method, as recited in claim 15, wherein the step (a) further comprises a step of automatically matching said infrared signal of said hand held controller to communicate with said signal receiver to remotely control said air vent arrangement.

19. The method, as recited in claim 10, wherein said control device further comprises a timer circuit to actuate said vent blades to rotate at a predetermined time setting.

20. The method, as recited in claim 15, wherein said control device further comprises a timer circuit to actuate said vent blades to rotate at a predetermined time setting.

* * * * *